US009523939B2

(12) United States Patent
Miyamoto et al.

(10) Patent No.: US 9,523,939 B2
(45) Date of Patent: Dec. 20, 2016

(54) LIQUID DEVELOPER AND METHOD FOR MANUFACTURING THE SAME

(71) Applicant: KYOCERA Document Solutions Inc., Osaka (JP)

(72) Inventors: Hidetoshi Miyamoto, Osaka (JP); Katsuki Osanishi, Osaka (JP); Yoshio Ozawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 69 days.

(21) Appl. No.: 14/340,764

(22) Filed: Jul. 25, 2014

(65) Prior Publication Data

US 2015/0037730 A1 Feb. 5, 2015

(30) Foreign Application Priority Data

Jul. 31, 2013 (JP) ..... 2013-158641

(51) Int. Cl.
*G03G 9/13* (2006.01)
*G03G 9/08* (2006.01)
*G03G 9/12* (2006.01)

(52) U.S. Cl.
CPC ..... *G03G 9/132* (2013.01); *G03G 9/0806* (2013.01); *G03G 9/12* (2013.01)

(58) Field of Classification Search
CPC ..... G03G 9/12; G03G 9/13; G03G 9/132; G03G 9/093; G03G 9/09307; G03G 9/09328
See application file for complete search history.

(56) References Cited

U.S. PATENT DOCUMENTS

| | | | | |
|---|---|---|---|---|
| 4,869,981 | A | 9/1989 | Wing, Jr. et al. | |
| 4,908,301 | A | 3/1990 | Grosso et al. | |
| 5,015,549 | A | 5/1991 | Grosso et al. | |
| 5,064,736 | A | 11/1991 | Grosso et al. | |
| 5,108,867 | A | 4/1992 | Wing, Jr. et al. | |
| 5,185,226 | A * | 2/1993 | Grosso | G03G 9/08 430/110.2 |
| 2003/0212198 | A1* | 11/2003 | Takao | C08F 257/02 524/588 |
| 2014/0087300 | A1* | 3/2014 | Uno | C09D 5/00 430/110.2 |

FOREIGN PATENT DOCUMENTS

| | | | |
|---|---|---|---|
| JP | H03-503458 | A | 8/1991 |
| JP | H09-080822 | A | 3/1997 |
| JP | 2007-148200 | A | 6/2007 |
| JP | 4858661 | B1 | 11/2011 |

* cited by examiner

*Primary Examiner* — Peter Vajda
(74) *Attorney, Agent, or Firm* — Studebaker & Brackett PC

(57) ABSTRACT

A liquid developer contains an electrically insulating liquid carrier and toner particles dispersed in the liquid carrier. Each toner particle includes a core and a shell layer that is formed on a surface of the core and contains a thermosetting resin.

7 Claims, 5 Drawing Sheets

| | Toner capsulation | Polyester resin (OHV) | Zeta potential before capsulation [mV] | Zeta potential after capsulation [mV] | Tm [°C] | Tg [°C] | Roundness | Image density | Fixability | | Preservability | | |
|---|---|---|---|---|---|---|---|---|---|---|---|---|---|
| | | | | | | | | | Lowest [°C] | Highest [°C] | 40°C | 50°C | 60°C |
| Sample 1 | Yes | Resin A(57.9) | −31 | 52 | 76.2 | 43.9 | 0.955 | 1.4 | 130 | 190 | Good | Good | Good |
| Sample 2 | Yes | Resin A(57.9) | −31 | 52 | 76.2 | 43.9 | 0.985 | 1.4 | 130 | 190 | Good | Good | Good |
| Sample 3 | Yes | Resin A(57.9) | −31 | 52 | 76.2 | 43.9 | 0.970 | 1.4 | 130 | 190 | Good | Good | Good |
| Sample 4 | Yes | Resin B(21.2) | −23 | 52 | 77.2 | 45.0 | 0.975 | 1.4 | 125 | 185 | Good | Good | Good |
| Sample 5 | Yes | Resin C(76.0) | −38 | 52 | 78.2 | 45.0 | 0.975 | 1.4 | 135 | 185 | Good | Good | Good |
| Sample 6 | Yes | Resin D(106.7) | −43 | 52 | 79.2 | 50.0 | 0.975 | 1.4 | 135 | 185 | Good | Good | Good |
| Sample 7 | No | Resin A(57.9) | −31 | – | 75.2 | 40.9 | 0.950 | 0.7 | 120 | 185 | Poor | Poor | Poor |
| Sample 8 | No | Resin A(57.9) | −31 | – | 75.2 | 40.9 | 0.988 | 0.7 | 120 | 185 | Poor | Poor | Poor |
| Sample 9 | No | Resin A(57.9) | −31 | – | 75.2 | 40.9 | 0.980 | 0.7 | 120 | 185 | Poor | Poor | Poor |
| Sample 10 | No | Resin B(21.2) | −23 | – | 76.7 | 42.9 | 0.975 | 0.8 | 120 | 185 | Poor | Poor | Poor |
| Sample 11 | No | Resin C(76.0) | −38 | – | 77.7 | 43.9 | 0.975 | 0.7 | 140 | 185 | Good | Poor | Poor |
| Sample 12 | No | Resin D(106.7) | −43 | – | 78.0 | 49.0 | 0.975 | 0.7 | 120 | 185 | Good | Poor | Poor |

FIG. 5

LIQUID DEVELOPER AND METHOD FOR MANUFACTURING THE SAME

INCORPORATION BY REFERENCE

The present application claims priority under 35 U.S.C. §119 to Japanese Patent Application No. 2013-158641, filed Jul. 31, 2013. The contents of this application are incorporated herein by reference in their entirety.

BACKGROUND

The present disclosure relates to a liquid developer and a method for manufacturing the same.

A liquid developer contains a liquid carrier and a plurality of toner particles dispersed in the liquid carrier. A challenge to be achieved by the liquid developer is to improve the fixability without compromising the sufficient preservability. To this end, a proposal is made to use, as the binder resin for forming toner particles, a polyester resin having a high glass transition point (Tg) and a low molecular weight. With the use of such a polyester resin, the preservability is improved by virtue of the high Tg of the polyester resin, whereas the fixability is improved by virtue of the low molecular weight of the polyester resin.

SUMMARY

To solve the problem stated above, the gist of the present disclosure is as follows.

A liquid developer according to the present disclosure contains an electrically insulating liquid carrier and toner particles dispersed in the liquid carrier. Each toner particle includes a core and a shell layer that is formed on a surface of the core and contains a thermosetting resin.

The manufacturing method for a liquid developer according to the present disclosure includes: preparing cores; forming, on a surface of each core, a shell layer containing a melamine resin or a derivative of the melamine resin through a polymerization reaction of an initial condensate of melamine formaldehyde or a derivative of the methylated melamine formaldehyde on the surface of the core; and dispersing the toner particles each having the core and the shell layer in an electrically insulating liquid carrier.

BRIEF DESCRIPTION OF THE DRAWINGS

FIG. 5 is a table showing evaluation results on samples prepared by the respective methods for manufacturing a liquid developer according to Examples of the present disclosure and Comparative Examples.

DETAILED DESCRIPTION

The following describes embodiments of the present disclosure.

Figure 1:
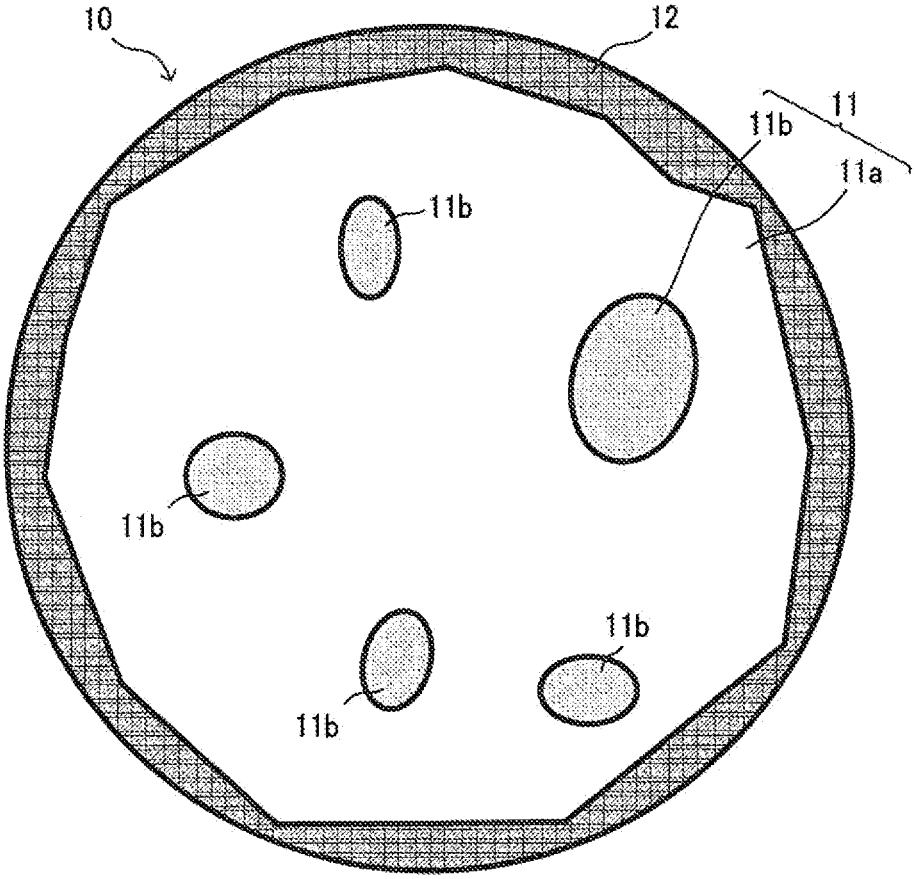
FIG. 1 is a cross sectional view schematically showing a structure of a toner particle contained in a liquid developer according to an embodiment of the present disclosure.

A liquid developer according to the present embodiment can be used for developing am an electrostatic latent image, for example. The liquid developer according to the present embodiment contains an electrically insulating carrier liquid and a toner dispersed in the carrier liquid (capsule toner, to be more specific). The toner contained in the liquid developer according to the present embodiment is powder formed from numerous particles (hereinafter, toner particles). With reference to FIG. 1, the following describes one example of a toner particle (a toner particle 10) contained in the liquid developer according to the present embodiment. FIG. 1 is a cross sectional view schematically showing the structure of the toner particle 10 contained in the liquid developer according to the present embodiment.

As shown in FIG. 1, the toner particle 10 contains an anionic core 11, and a cationic shell layer 12 (capsule layer) formed on the surface of the core 11.

The core 11 contains a binder resin 11*a* and an internal additive 11*b* (such as a colorant, a release agent, a charge control agent, or a magnetic powder). The core 11 is coated with the shell layer 12.

The structure of the toner particle is, however, not limited to that described above. For example, the toner particle may contain a plurality of shell layers stacked on one another on the surface of the core. If the toner particle has a plurality of shell layers, the outermost one of the shell layers preferably has a cationic property.

Preferably, the core 11 has an aniconic property and the shell material (material of the shell layers 12) has a cationic property. Since the core 11 is anionic, the cationic shell material of the shell layer 12 can be drawn onto the surface of the core 11 in forming the shell layer 12. In an aqueous medium, for example, the shell material is positively charged and thus electrically drawn to the core 11 that is negatively charged. As a result, in-situ polymerization (polymerization reaction) is caused to form the shell layer 12 on the surface of the core 11. Probably because the material of the shell 12 is drawn to the core 11, the shell layer 12 can be easily uniformly formed on the surface of the core 11 without requiring the cores 11 to be highly dispersed in the aqueous medium by using a dispersant.

As an index of the core 11 having an anionic property, the zeta potential of the core 11 measured in an aqueous medium adjusted to pH 4 (hereinafter designated as the zeta potential at pH 4) is negative (i.e., below 0 V). In order to strengthen the bond between the core 11 and the shell layer 12, it is preferable that the zeta potential of the core 11 at pH 4 should be below 0 V, whereas the zeta potential of the toner particle 10 at pH 4 should be above 0 V.

As a method for measuring a zeta potential, for example, an electrophoresis method, an ultrasonic method, or an ESA method is employed In the electrophoresis method, an electric field is applied to a particle dispersion for electrophoresing charged particles in the dispersion, so as to calculate a zeta potential on the basis of the electrophoretic mobility. An example of the electrophoresis method includes a laser Doppler method (in which electrophoresing particles are irradiated with a laser beam to obtain the electrophoretic mobility on the basis of Doppler shift of scattered light thus obtained). The laser Doppler method is advantageous in that there is no need to increase the particle concentration in the dispersion, that the number of parameters necessary for calculating a zeta potential is small, and that the electrophoretic mobility can be detected with high sensitivity.

In the ultrasonic method, a particle dispersion is irradiated with an ultrasonic wave for vibrating charged particles in the dispersion, and a zeta potential is calculated on the basis of a potential difference caused by the vibration.

In the ESA method, a high frequency voltage is applied to a particle dispersion for vibrating charged particles in the dispersion so as to cause an ultrasonic wave. Then, a zeta potential is calculated on the basis of the magnitude (strength) of the ultrasonic wave.

Each of the ultrasonic method and the ESA method is advantageous in that a zeta potential can be measured with high sensitivity even if a particle dispersion has a high particle concentration (beyond 20% by mass, for example).

Even if the core 11 is of low roundness, the provision of the shell layer 12 may improve the roundness of the toner particle 10. To enable the developing and transferring processes at high speed by using a high-viscosity carrier liquid, the toner particles 10 preferably have a roundness falling within the range of 0.95 to 0.99. Also, the toner particles 10 preferably have a volume average particle diameter ($D_{50}$) falling within the range of 0.5 μm and 5.0 μm.

From the viewpoint of carbon neutral, the toner preferably contains a biomass-derived material. Specifically, a ratio of the biomass-derived carbon in the entire carbon content in the toner is preferably 25% by mass or more and 90% by mass or less. The type of biomass is not specifically limited, and the biomass may be a plant biomass or an animal biomass. Among various biomass-derived materials, however, a plant biomass-derived material is more preferred as such a material is readily available at a low cost and in a large amount.

In $CO_2$ present in the air, the concentration of $CO_2$ containing radioactive carbon ($^{14}C$) is retained constant in the air. On the other hand, plants incorporate $CO_2$ containing $^{14}C$ from the air during photosynthesis. Therefore, the concentration of $^{14}C$ in carbon contained in an organic component of a plant is usually equivalent to the concentration of $CO_2$ containing $^{14}C$ in the air. The concentration of $^{14}C$ in carbon contained in an organic component of a general plant is approximately 107.5 pMC (percent Modern Carbon). Besides, carbon contained in animals is derived from carbon contained in plants. Therefore, the concentration of $^{14}C$ in carbon contained in an organic component of an animal also shows a similar tendency to that in a plant.

The ratio of biomass-derived carbon in the entire carbon content in a toner can be obtained, for example, in accordance with Formula 1 below.

$$\text{Ratio of biomass-derived carbon (\% by mass)} = (X/107.5)\times 100 \quad \text{[Formula 1]}$$

In Formula 1, X (pMC) represents a concentration of $^{14}C$ contained in the toner. The concentration of $^{14}C$ in a carbon element of a petrochemical can be measured in accordance with, for example, ASTM-D6866. On the basis of Formula 1 and ASTM-D6866, the ratio of biomass-derived carbon in the entire carbon content and the concentration of $^{14}C$ in the toner can be obtained.

From the viewpoint of the carbon neutral, a plastic product containing biomass-derived carbon in a ratio of 25% by mass or more in the entire carbon contained therein is preferred. Such a plastic product is given a BiomassPla mark (certified by Japan BioPlastics Association). In the case where the ratio of the biomass-derived carbon in the entire carbon content in the toner is 25% by mass or more, the concentration X of $^{14}C$ in the toner obtained by Formula 1 is 26.9 pMC or more.

The following now sequentially describes the core 11 (the binder resin 11*a* and the internal additive 11*b*), and the shell layer 12 (a resin and a charge control agent).

[Core]

The core 11 constituting the toner particle 10 contains the binder resin 11*a*. Besides, the core 11 may contain the internal additive 11*b* (such as a colorant, a release agent, a charge control agent, and a magnetic powder). Note that the core 11 is not required to contain all of these components. Depending, for example, on the intended use of the toner, components not essential for that use (such as a colorant, a release agent, a charge control agent, or a magnetic powder) may be omitted.

[Binder Resin (Core)]

In the core 11, the binder resin 11*a* occupies most of the core component (for example, 85% by mass or more) in many cases. Therefore, it is regarded that the polarity of the binder resin 11*a* largely affects the polarity of the core 11 as a whole. If the binder resin 11*a* has, for example, an ester group, a hydroxyl group, an ether group, an acid group, or a methyl group, the core 11 is liable to be anionic. On the other hand, if the binder resin 11*a* has an amino group, an amine or an amide group, the core 11 is liable to be cationic.

In order for the core 11 to be strongly anionic, the hydroxyl value (OHV value) and the acid value (AV value) of the binder resin 11*a* are both preferably 10 mgKOH/g or more, and more preferably 20 mgKOH/g or more. The hydroxyl value (OHV value) and the acid value (AV value) of the binder resin 11*a* can be measured in accordance with JIS K 0070-1992.

The solubility parameter (SP value) of the binder resin 11*a* is preferably 10 or more, and more preferably 15 or more. If the SP value is 10 or more, the wettability of the binder resin 11*a* to an aqueous medium is improved because its SP value is close to the SP value of water (that is, 23). Therefore, the dispersibility of the binder resin 11*a* in an aqueous medium can be improved even without using a dispersant.

The glass transition point (Tg) of the binder resin 11*a* is preferably equal to or lower than the curing start temperature of a thermosetting resin contained in the shell layer 12. If the binder resin 11*a* has such a Tg, the toner is presumed to be less prone to decrease in fixability even in a high-speed fixing operation. The curing start temperature of many of thermosetting resins (particularly, melamine-based resins) is approximately 55° C. The Tg of the binder resin 11*a* is preferably 20° C. or more, more preferably 30° C. or more and 55° C. or less, and further more preferably 30° C. or more and 50° C. or less. If the Tg of the binder resin 11*a* is 20° C. or more, the core 11 is less prone to aggregation when forming the shell layer 12.

The glass transition point (Tg) of the binder resin 11*a* can be measured by the following method. The glass transition point (Tg) of the binder resin 11*a* can be obtained on the basis of a heat absorption curve (more specifically, a point of change in specific heat of the binder resin 11*a*) obtained by using a differential scanning calorimeter (DSC) (such as "DSC-6200" manufactured by Seiko Instruments Inc.). For example, with 10 mg of the binder resin 11*a* (measurement sample) put in an aluminum pan, and with an empty aluminum pan used as a reference, a heat absorption curve of the binder resin 11*a* can be obtained through measurement performed under conditions of a measurement temperature range of 25° C. to 200° C. and a temperature increasing rate of 10° C./min. The glass transition point (Tg) of the binder resin can be obtained based on the thus obtained heat absorption curve of the binder resin 11*a*.

The softening point (Tm) of the binder resin 11*a* is preferably 100° C. or less, and more preferably 80° C. or less. If the Tm of the binder resin 11*a* is 100° C. or less (more preferably 80° C. or less), the fixability of the toner is less prone to decrease even in a high-speed fixing operation. In addition, the Tm of the binder resin 11*a* may be adjusted by combining a plurality of resins each having a different Tm.

Figure 2:
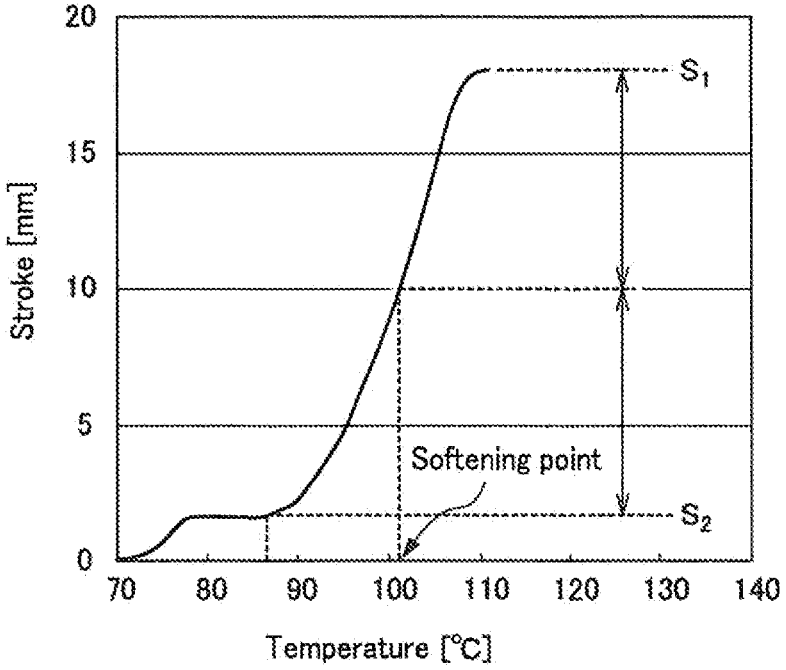
FIG. 2 is a view illustrating a method of reading a softening point from an S-shaped curve.

The glass softening point (Tm) of the binder resin 11*a* can be measured by the following method. The softening point (Tm) of the binder resin 11*a* can be measured by using an elevated flow tester (such as "CFT-500D" manufactured by Shimadzu Corporation). For example, with the binder resin 11*a* (measurement sample) set on the elevated flow tester, 1 $cm^3$ of the sample is melt flown under conditions of a die diameter of 1 mm, a plunger load of 20 $kg/cm^2$, and a temperature increasing rate of 6° C./min, and thus, an S shaped curve pertaining to the temperature (° C.)/stroke (mm) can be obtained. Then, the Tm of the binder resin 11*a* can be read from the thus obtained S shaped curve. FIG. 2 is a graph illustrating an example of the S shaped curve. In FIG. 2, S1 represents the maximum value of the stroke, and S2 represents a stroke value corresponding to a low-temperature-side base line. On the S shaped curve, a temperature corresponding to a stroke value of (S1+S2)/2 corresponds to the Tm of the measurement sample.

The binder resin 11*a* of FIG. 1 will be continuously described. As the binder resin 11*a*, a rein having, in a molecule, a functional group such as an ester group, a hydroxyl group, an ether group, an acid group, a methyl group, or a carboxyl group is preferred, and a resin having, in a molecule, a hydroxyl group and/or a carboxyl group is more preferred. The core 11 (the binder resin 11*a*) having such a functional group easily reacts with the material of the shell layer 12 (such as methylol melamine) to be chemically bonded thereto. When such a chemical bond is formed, the bond between the core 11 and the shell layer 12 becomes strong.

As the binder resin 11*a*, a thermoplastic resin is preferably used. Suitable examples of the thermoplastic resin used as the binder resin 11*a* include styrene-based resins, acrylic resins, styrene acrylic-based resins, polyethylene-based resins, polypropylene-based resins, vinyl chloride-based resins, polyester resins, polyamide-based resins, polyurethane-based resins, polyvinyl alcohol-based resins, vinyl ether-based resins, N-vinyl-based resins, and styrene-butadiene-based resins. Among these resins, styrene acrylic-based resins and polyester resins are excellent in the dispersibility of a colorant in the toner, the chargeability of the toner, and the fixability of the toner onto a recording medium.

(Styrene-Acrylic Resin)

A styrene acrylic-based resin is a copolymer of a styrene-based monomer and an acrylic-based monomer.

Suitable examples of the styrene-based monomer used in preparing the styrene acrylic-based resin (the binder resin 11*a*) include styrene, α-methylstyrene, p-hydroxystyrene, m-hydroxystyrene, vinyl toluene, α-chlorostyrene, o-chlorostyrene, m-chlorostyrene, p-chlorostyrene, and p-ethylstyrene.

Suitable examples of the acrylic-based monomer used in preparing the styrene acrylic-based resin (the binder resin 11*a*) include (meth)acrylic acid, (meth)acrylic acid alkyl ester, and (meth)acrylic acid hydroxyalkyl ester. Suitable examples of the (meth)acrylic acid alkyl ester include methyl (meth)acrylate, ethyl (meth)acrylate, n-propyl (meth)acrylate, iso-propyl (meth)acrylate, n-butyl (meth) acrylate, iso-butyl (meth)acrylate, and 2-ethylhexyl (meth) acrylate. Suitable examples of the (meth)acrylic acid hydroxyalkyl ester include 2-hydroxyethyl (meth)acrylate, 3-hydroxypropyl (meth)acrylate, 2-hydroxypropyl (meth) acrylate, and 4-hydroxypropyl (meth)acrylate.

In preparation of the styrene acrylic-based resin, a hydroxy group can be introduced into the styrene acrylic-based resin by using a monomer having a hydroxyl group (such as p-hydroxystyrene, m-hydroxystyrene, or hydroxyalkyl (meth)acrylate). By appropriately adjusting the amount of the monomer having a hydroxyl group to be used, the hydroxyl value of the resultant styrene acrylic-based resin can be adjusted.

In preparation of the styrene acrylic-based resin, a carboxyl group can be introduced into the styrene acrylic-based resin by using (meth)acrylic acid (a monomer). By appropriately adjusting the amount of the (meth)acrylic acid to be used, the acid value of the resultant styrene acrylic-based resin can be adjusted.

From the viewpoint of the carbon neutral, the binder resin 11*a* is preferably a resin synthesized from biomass-derived acrylic acid or acrylate. An example of a method for preparing the biomass-derived acrylic acid include a method in which biomass-derived glycerin (a method for preparing glycerin will be described later) is dehydrated to yield acrolein and the resultant acrolein is oxidized. Alternatively, the biomass-derived acrylate can be prepared by esterifying the biomass-derived acrylic acid by a known method. As an alcohol used in preparing the acrylate, methanol or ethanol prepared from a biomass by a known method is preferably used.

If the binder resin 11*a* is a styrene acrylic-based resin, the number average molecular weight (Mn) of the styrene acrylic-based resin is preferably 2000 or more and 3000 or less for improving the strength of the core 11 or the fixability of the toner. A molecular weight distribution (i.e., a ratio Mw/Mn between the number average molecular weight (Mn) and the mass average molecular weight (Mw)) of the styrene acrylic-based resin is preferably 10 or more and 20 or less. For measuring the Mn and the Mw of the styrene acrylic-based resin, gel permeation chromatography can be employed.

(Polyester Resin)

A polyester resin used as the binder resin 11*a* is obtained through condensation polymerization or co-condensation polymerization of, for example, a bivalent, trivalent, or higher valent alcohol and a bivalent, trivalent, or higher valent carboxylic acid.

If the binder resin 11*a* is a polyester resin, suitable examples of an alcohol used for preparing the polyester resin include diols, bisphenols, and trivalent or higher valent alcohols.

Specific examples of the diols include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Specific examples of the bisphenols include bisphenol A, hydrogenated bisphenol A, polyoxyethylene-modified bisphenol A, and polyoxypropylene-modified bisphenol A.

Specific examples of the trivalent or higher valent alcohols include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methyl propanetriol, 2-methyl-1,2,4-butanetriol, trimethylolethane, trimethylolpropane, and 1,3,5-trihydroxymethylbenzene.

If the binder resin 11*a* is a polyester resin, suitable examples of a carboxylic acid used in preparing the polyester resin include bivalent carboxylic acids and trivalent or higher valent carboxylic acids.

Specific examples of the bivalent carboxylic acids include maleic acid, fumaric acid, citraconic acid, itaconic acid, glutaconic acid, phthalic acid, isophthalic acid, terephthalic acid, cyclohexane dicarboxylic acid, adipic acid, sebacic acid, azelaic acid, malonic acid, succinic acid, and alkyl succinic acid, or alkenyl succinic acid (n-butyl succinic acid, n-butenyl succinic acid, isobutyl succinic acid, isobutenyl succinic acid, n-octyl succinic acid, n-octenyl succinic acid, n-dodecyl succinic acid, n-dodecenyl succinic acid, isododecyl succinic acid, or isododecenyl succinic acid).

Specific examples of the trivalent or higher valent carboxylic acids include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylene carboxy propane, 1,2,4-cyclohexanetricarboxylic acid, tetra(methylenecarboxyl) methane, 1,2,7,8-octanetetracarboxylic acid, pyromellitic acid, and Empol trimer acid.

Furthermore, any of the aforementioned bivalent, trivalent, or higher valent carboxylic acids may be used in the form of an ester-forming derivative (such as an acid halide, an acid anhydride, or a lower alkyl ester). The term "lower alkyl" used herein refers to an alkyl group having 1 to 6 carbon atoms.

The acid value and the hydroxyl value of the polyester resin can be adjusted by appropriately changing the amount of a bivalent, trivalent or higher valent alcohol and the amount of a bivalent, trivalent or higher valent carboxylic acid to be used in producing the polyester resin. The acid value and the hydroxyl value of the polyester resin tend to be lowered by increasing the molecular weight of the polyester resin.

From the viewpoint of the carbon neutral, the binder resin 11*a* is preferably a polyester resin synthesized from a biomass-derived alcohol (such as 1,2-propanediol, 1,3-propanediol, or glycerin). An example of the method for preparing glycerin from a biomass includes a method in which vegetable oil or animal oil is hydrolyzed by a chemical method using an acid or a base, or by a biological method using an enzyme or microorganism. Alternatively, glycerin may be produced from a substrate containing saccharides such as glucose by a fermentation method. The alcohol such as 1,2-propanediol or 1,3-propanediol can be produced by using, as a raw material, the glycerin obtained as described above. The glycerin can be chemically transformed into a target substance by a known method. From the viewpoint of the carbon neutral, the ratio of the biomass-derived carbon in the polyester resin (the binder resin 11*a*) is preferably adjusted so that the concentration of the radioactive carbon isotope $^{14}C$ in the entire carbon content in the toner can be 26.9 pMC or more.

If the binder resin 11*a* is a polyester resin, the number average molecular weight (Mn) of the polyester resin is preferably 1200 or more and 2000 or less for improving the strength of the core 11 or the fixability of the toner. A molecular weight distribution (i.e., a ratio Mw/Mn between the number average molecular weight (Mn) and the mass average molecular weight (Mw)) of the polyester resin is preferably 9 or more and 20 or less. For measuring the Mn and the Mw of the polyester resin, the gel permeation chromatography can be employed.

[Colorant (Core)]

The core 11 may contain a colorant if necessary. As the colorant, any of known pigments or dyes can be used in accordance with the color of the toner. The amount of the colorant to be used is preferably 1 part by mass or more and 20 parts by mass or less, and more preferably 3 parts by mass or more and 10 parts by mass or less based on 100 parts by mass of the binder resin 11*a*.

(Black Colorant)

The core 11 may contain a black colorant. An example of the black colorant includes carbon black. For example, with the addition of a carbon black in an amount of 20% by mass or more to the toner particles 10, the amount of toner sufficient for developing can be made as small as 0.1 mg/cm$^2$ or less. The black colorant may be a colorant whose color is adjusted to black by using a yellow colorant, a magenta colorant, and a cyan colorant.

(Colorant)

The core 11 may contain a colorant such as a yellow colorant, a magenta colorant, or a cyan colorant.

Examples of the yellow colorant include condensed azo compounds, isoindolinone compounds, anthraquinone compounds, azo metal complexes, methine compounds, and allylamide compounds. Suitable examples of the yellow colorant include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Bat Yellow.

Examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. A suitable example of the magenta colorant includes C.I. Pigment Red (2, 3, 5, 6, 7, 19, 23, 48:2, 48:3, 48:4, 57:1 81:1, 122, 144, 146, 150, 166, 169, 177, 184, 185, 202, 206, 220, 221, or 254).

Examples of the cyan colorant include copper phthalocyanine compounds, copper phthalocyanine derivatives, anthraquinone compounds, and basic dye lake compounds. Suitable examples of the cyan colorant include C.I. Pigment Blue (1, 7, 15, 15:1, 15:2, 15:3, 15:4, 60, 62, or 66), phthalocyanine blue, C.I. Bat Blue, and C.I. Acid Blue.

[Release Agent (Core)]

The core 11 may contain a colorant if necessary. The release agent is used for purpose of improving the fixability or the offset resistance of the toner. In order to improve the fixability or the offset resistance of the toner, the amount of the release agent to be used is preferably 1 part by mass or more and 30 parts by mass or less, and more preferably 5 parts by mass or more and 20 parts by mass or less based on 100 parts by mass of the binder resin.

Examples of the release agent include: aliphatic hydrocarbon-based waxes, such as low molecular weight polyethylene, low molecular weight polypropylene, polyolefin copolymers, polyolefin wax, microcrystalline wax, paraffin wax, and Fischer-Tropsch wax; oxides of the aliphatic hydrocarbon-based waxes such as polyethylene oxide wax, and a block copolymer of polyethylene oxide wax; vegetable waxes such as candelilla wax, carnauba wax, haze wax, jojoba wax, and rice wax; animal waxes such as beeswax, lanolin, and spermaceti wax; mineral waxes such as ozokerite, ceresin, and petrolatum; waxes containing a fatty acid ester as a principal component, such as montanic acid ester wax, and castor wax; and waxes obtained by deoxidizing part or whole of fatty acid ester, such as deoxidized carnauba wax.

[Charge Control Agent (Core)]

The core 11 may contain a charge control agent if necessary. The charge control agent is used for purpose of improving the charge level or the charge rising property of a toner so as to yield a toner excellent in the durability or the stability. The charge rising property of a toner is an index of whether or not the toner can be charged to a prescribed charge level in a short period of time.

The presence of a negatively chargeable charge control agent in the core 11 can enhance the anionic property (negative chargeability) of the core 11. In order to improve the charge stability, the charge rising property, the durability, or the stability of the toner, or in order to reduce the cost for producing the toner, the amount of the negatively chargeable charge control agent to be used is preferably 0.5 part by mass or more and 20.0 parts by mass or less, and more preferably 1.0 part by mass or more and 15.0 parts by mass or less based on 100 parts by mass based on the binder resin 11*a*.

Examples of the negatively chargeable charge control agent include organic metal complexes and chelate compounds. As the organic metal complexes and the chelate compounds used as the negatively chargeable charge control agent, acetylacetone metal complexes (such as aluminum acetyl acetonate and iron (II) acetyl acetonate), salicylic acid-based metal complexes and salicylic acid-based metal salts (such as chromium 3,5-di-tert-butylsalicylate) are preferred, and a salicylic acid-based metal complex or a salicylic acid-based metal salt is more preferred. One of these charge control agents may be singly used, or two or more of these charge control agents may be used in combination.

[Magnetic Powder (Core)]

The core 11 may contain a magnetic powder if necessary. If the toner is used as a one-component developer, in order to improve the magnetic property or the fixability of the toner, the amount of the magnetic powder to be used is preferably 35 parts by mass or more and 60 parts by mass or less, and more preferably 40 parts by mass or more and 60 parts by mass or less based on 100 parts by mass of (the total amount of) the toner. Alternatively, if the toner is used as a two-component developer, in order to improve the magnetic property or the fixability of the toner, the amount of the magnetic powder to be used is preferably 20 parts by mass or less, and more preferably 15 parts by mass or less based on 100 parts by mass of (the total amount of) the toner.

Suitable examples of a material of the magnetic powder include iron (such as ferrite or magnetite), ferromagnetic metals (such as cobalt or nickel), alloys containing iron and/or a ferromagnetic metal, compounds containing iron and/or a ferromagnetic metal, ferromagnetic alloys having been ferromagnetized (for example, by heating), and chromium dioxide.

The particle size of the magnetic powder is preferably 0.1 μm or more and 1.0 μm or less, and more preferably 0.1 μm or more and 0.5 μm or less. If the particle size of the magnetic powder is 0.1 μm or more and 1.0 μm or less, the magnetic powder can be easily homogeneously dispersed in the binder resin 11*a*.

[Shell Layer]

The shell layer 12 is preferably constituted mainly from a thermosetting resin. Besides, in order to improve the strength, the hardness, or the cationic property of the shell layer 12, the shell layer 12 more preferably contains a resin having an amino group. If the shell layer 12 contains a nitrogen atom, it can be easily positively chargeable. In order to enhance the cationic property of the shell layer 12, the content of the nitrogen atom in the shell layer 12 is preferably 10% by mass or more.

In addition, the content of the thermosetting resin in the resin contained in the shell layer 12 is preferably 80% by mass or more, more preferably 90% by mass or more, and further more preferably 100% by mass.

Preferable examples of the thermosetting resin constituting the shell layer 12 include a melamine resin, a urea resin, a sulfonamide resin, a glyoxal resin, a guanamine resin, an aniline resin, a polyimide resin, and a derivative of any of these resins. The polyimide resin has a nitrogen element in its molecular skeleton. Therefore, the shell layer 12 containing the polyimide resin is liable to be strongly cationic. Suitable examples of the polyimide resin constituting the shell layer 12 include a maleimide-based polymer, and a bismaleimide-based polymer (such as an amino bismaleimide polymer or a bismaleimide triazine polymer).

As the thermosetting resin constituting the shell layer 12, a resin produced through condensation polymerization of a compound having an amino group and aldehyde (such as formaldehyde) is particularly preferred (the resin is hereinafter referred to as an amino aldehyde resin). It is noted that a melamine resin is a polycondensate of melamine and formaldehyde. A urea resin is a polycondensate of urea and formaldehyde. A glyoxal resin is a polycondensate of a reactant of glyoxal and urea, and formaldehyde.

The thickness of the shell layer 12 is preferably 1 nm or more and 20 nm or less, and more preferably 1 nm or more and 10 nm or less. If the thickness of the shell layer 12 is 20 nm or less, the shell layer 12 can be easily broken by heat and pressure applied in fixing the toner onto a recording medium. As a result, the binder resin 11*a* and the release agent contained in the core 11 are rapidly softened or molten, so that the toner can be fixed on the recording medium at a low temperature. Besides, if the thickness of the shell layer 12 is 20 nm or less, the chargeability of the shell layer 12 cannot be too strong, and hence, image formation can be properly performed. On the other hand, if the thickness of the shell layer 12 is 1 nm or more, the strength of the shell layer 12 is sufficiently large, and hence, the shell layer 12 is difficult to break even when impact is applied to the toner (for example, during transportation). As a result, the preservability of the toner is improved.

The thickness of the shell layer 12 can be measured by analyzing a TEM image of the cross-section of the toner particle 10 by using commercially available image analysis software (such as "WinROOF" manufactured by Mitani Corporation). If the shell layer is too thin, the interface between the core and the shell layer may be unclear on a TEM image, which makes it difficult to measure the thickness of the shell layer. In such a case, the interface between the core and the shell layer can be made clear by combining a TEM image with electron energy loss spectroscopy (EELS) for measuring the thickness of the shell layer. Specifically, mapping of an element characteristic of the material of the shell layer (a nitrogen element, for example) was performed on the TEM image by the EELS.

The shell layer 12 preferably has a fracture portion (that is, a portion with low mechanical strength). A fracture portion can be formed by locally causing a defect in the shell layer 12. The shell layer 12 having a fracture portion can be easily broken by applying heat and pressure for fixing the toner onto a recording medium. As a result, even if the shell layer 12 is constituted from a thermosetting resin, the toner can be fixed on a recording medium at a low temperature. The number of fracture portions to be provided is arbitrary

[Charge Control Agent (Shell Layer)]

The shell layer 12 may contain a charge control agent if necessary. The charge control agent is used for purpose of improving the charge level or the charge rising property of a toner so as to yield a toner excellent in the durability or the stability.

The presence of a positively chargeable charge control agent in the shell layer 12, the cationic property (positive chargeability) of the shell layer 12 can be enhanced. In order to improve the charge rising property, the durability, or the stability of the toner, or in order to lower the cost for producing the toner, the amount of the positively chargeable charge control agent to be used is preferably 0.5 part by mass or more and 20.0 parts by mass or less, and more preferably 1.0 part by mass or more and 15.0 parts by mass or less based on 100 parts by mass of the resin constituting the shell layer 12.

Suitable examples of the positively chargeable charge control agent include an azine compound (a direct dye containing an azine compound), a nigrosine compound (an acidic dye containing a nigrosine compound), a metal salt of naphthenic acid or higher fatty acid, alkoxylated amine, alkyl amide, and a quaternary ammonium salt. For improving the charge rising property of the toner, a nigrosine compound is particularly preferred. One of these charge control agents may be singly used, or two or more of these may be used in combination.

Specific examples of the azine compound include pyridazine, pyrimidine, pyrazine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline. Specific examples of the direct dye containing an azine compound include azine fast red FC, azine fast red 12BK, azine violet BO, azine brown 3G, azine light brown GR, azine dark green BH/C, azine deep black EW, and azine deep black 3RL. Specific examples of the nigrosine compound include nigrosine, a nigrosine salt, and a nigrosine derivative. Specific examples of the acidic dye containing a nigrosine compound include nigrosine BK, nigrosine NB, and nigrosine Z. Specific examples of the quaternary ammonium salt include benzyldecylhexylmethyl ammonium chloride, decyl trimethyl ammonium chloride, tributyl benzyl ammonium-1-hydroxy-4-naphthalene sulfonate, tributyl benzyl ammonium-2-hydroxy-8-naphthalene sulfonate, triethyl benzyl ammonium-1-hydroxy-4-naphthalene sulfonate, tripropyl benzyl ammonium-1-hydroxy-4-naphthalene sulfonate, tripropyl benzyl ammonium-2-hydroxy-6-naphthalene sulfonate, trihexyl benzyl ammonium-1-hydroxy-4-naphthalene sulfonate, tetrabutyl ammonium-1-hydroxy-4-naphthalene sulfonate, and tetraoctyl ammonium-1-hydroxy-4-naphthalene sulfonate.

Also, a resin containing at least one of a quaternary ammonium salt, a carboxylate, and a carboxyl group (such as a styrene-based resin, an acrylic-based resin, a styrene-acrylic-based resin, or a polyester resin) can be used as the positively chargeable charge control agent. One of such resins may be singly used, or two or more of these may be used in combination. The molecular weight of the resin is arbitrary.

In the liquid developer according to the present embodiment, the toner (a plurality of toner particles 10) is dispersed in an electrically insulating carrier liquid. In addition, a dispersant may be added to the carrier liquid. The following describes the carrier liquid and the dispersant.

[Carrier Liquid]

The carrier liquid for the liquid developer according to the present embodiment is electrically insulating. The volume resistivity of the carrier liquid at 25° C. is preferably $10^{10}$ Ω·cm or more (in other words, the electrical conductivity is preferably 100 pS/cm or less).

Preferably, the carrier liquid is constituted mainly from an electrically insulating organic solvent. Suitable examples of the organic solvent constituting the carrier liquid include non-volatile paraffin oil having a relatively high molecular weight. Alternatively, however, the carrier liquid may be constituted from aliphatic hydrocarbon-based (normal paraffin-based or isoparaffin-based) low-viscosity oil or high-boiling oil having a high carbon content. In order to reduce the volatile organic compound (VOC) in the carrier liquid, the carrier liquid is preferably constituted mainly from a low-volatile organic solvent having a boiling point of 200° C. or more (for example, liquid paraffin containing a large amount of aliphatic hydrocarbon having 16 or more carbon atoms).

As the organic solvent constituting the carrier liquid, aliphatic hydrocarbon that is liquid at room temperature (n-paraffin-based hydrocarbon, iso-paraffin-based hydrocarbon, or a mixture thereof) is preferred, and branched-chain aliphatic hydrocarbon is particularly preferred. Specific examples of straight- or branched-chain hydrocarbon that is liquid at room temperature include n-hexane, n-heptane, n-octane, nonane, decane, dodecane, hexadecane, heptadecane, cyclohexane, perchloroethylene, and trichloroethane.

The following are commercial products suitably usable as the carrier liquid. Examples of the commercial products suitably usable as the carrier liquid include: branched-chain aliphatic hydrocarbon such as "Isopar G", "Isopar H", "Isopar K", "Isopar L", "Isopar M", or "Isopar V" manufactured by Exxon Mobil Corporation ("Isopar" is a registered trademark); liquid paraffin such as "MORESCO WHITE P-40", "MORESCO WHITE P-55", "MORESCO WHITE P-70", or "MORESCO WHITE P-200" manufactured by MORESCO Corporation ("MORESCO WHITE" is a registered trademark); liquid paraffin such as "Cosmo White P-60", "Cosmo White P-70", or "Cosmo White P-120" manufactured by COSMO OIL Co., Ltd.; and isoparaffin-based hydrocarbon such as "IP Solvent 1620" or "IP Solvent 2028" manufactured by Idemitsu Kosan Co., Ltd.

[Dispersant]

For example, the dispersant is used to accelerate and stabilize the dispersion of the toner particles 10 in the carrier liquid. The content of the dispersant in the carrier liquid is preferably 1% by mass or more and 10% by mass or less, and more preferably 2% by mass or more and 6% by mass or less.

Specific examples of the dispersant added to the carrier liquid include hydroxy group-containing carboxylate, modified polyurethane, modified polyacrylate, polyether-ester anion activator, naphthalenesulfonic acid-formaldehyde condensate salt, aromatic sulfonic acid formalin condensate salt, polyoxyethylene alkyl phosphoric acid ester, polyoxyethylene nonylphenylether, stearylamine acetate, and silicone-based activator. Suitable examples of the dispersant include a fatty acid polyester amine polymer and polyvinylpyrrolidone.

If the fatty acid polyester amine polymer is used as the dispersant to be added to the carrier liquid, the weight average molecular weight of the fatty acid polyester amine polymer preferably falls within the range of 500 to 20,000, and more preferably within the range of 1,000 to 10,000, and further more preferably within the range of 2,000 to 8,000, for example. The fatty acid polyester amine polymer may be a straight-chain polymer or a branched-chain (comb-shaped) polymer. The branched-chain polymer tends to compare favorably with the straight-chain polymer in the adsorption to a polyester resin. The branched-chain fatty acid polyester amine polymer can be synthesized from at least one of polyester having a branched carbon chain or a polyalkylenimine compound having a branched chain. The fatty acid polyester amine polymer can be synthesized through a reaction of a carboxyl group at the end of polyester (terminal carboxylic acid) with a polyalkylenimine compound or with an amino compound. The polyester used for synthesis of the fatty acid polyester amine polymer is obtained through polymerization of an aliphatic polycarboxylic acid with a polyvalent alcohol or through condensation polymerization of an aliphatic hydroxycarboxylic acid having, in a molecule, a hydroxyl group and a carboxyl group (for example, 12-hydroxystearic acid). Suitable examples of the polyalkylenimine compound include an alkyleneimine compound having 1 to 4 carbon atoms.

The following are commercial products suitably usable as the dispersant added to the carrier liquid. Examples of the commercial products suitably usable as the dispersant includes: "Solsperse 9000", "Solsperse 11200", "Solsperse 13940", "Solsperse 16000", "Solsperse 17000" and "Solsperse 18000" manufactured by the Lubrizol Corporation; "Antaron V-216", "Antaron V-220", and "Antaron W-660" manufactured by ISP Japan Ltd. ("Antaron" is a registered trademark); and "Disperbyk-109" and "Disperbyk-130" manufactured by BYK Chemie Co., Ltd. The weight average molecular weight of "Solsperse 13940" is about 3000. Note that the "Solsperse 13940" is synthesized through a reaction between an amino compound and a terminal carboxylic acid of the polyester obtained through condensation polymerization of 12-hydroxystearic acid.

EXAMPLES

The following describes Examples of the present disclosure.

[Method for Manufacturing Liquid Developer]

Samples 1 to 12 (more specifically, liquid developers shown in FIG. 5, which will be described later) were manufactured by the respective methods described below. In each method for preparing the corresponding sample, a toner was prepared and dispersed in a carrier liquid to manufacture a liquid developer. The following sequentially describes the process of preparing a toner and the process of dispersing the toner in a carrier liquid.

(Preparation of Binder Resin)

The respective methods for preparing Samples 1 to 12 each used one of four polyester resins A to D as the binder resin contained in the cores. The following now describes the respective methods for synthesizing the polyester resins A to D.

<Method for Synthesizing Polyester Resin A>

A reaction vessel provided with a cooling tube, a stirrer, and a nitrogen inlet tube was charged with 415 parts by mass (1.3 moles) of bisphenol A-EO (ethylene oxide) 2 mole adduct, 447 parts by mass (1.3 moles) of bisphenol A-PO (propylene oxide) 2 mole adduct, 332 parts by mass (2.0 moles) of terephthalic acid, and 3 parts by mass of tetrabutoxytitanate as a condensation catalyst.

Subsequently, the content of the reaction vessel was reacted for 5 hours under a nitrogen stream and at 230° C. while the produced water was distilled off. Subsequently, the content of the reaction vessel was reacted under a reduced pressure of 10 mmHg, and the temperature within the reaction vessel was cooled to 180° C. when the acid value (AV value) of the content of the reaction vessel reached 2 mgKOH/g or less. Specifically speaking, the acid value (AV value) was measured in accordance with BS K 0070-1992 in the following manner. That is, with the use of a glass rod, a sample was extracted from the mixture in the reaction vessel at every 30 minutes after a lapse of two hours from the start of the reaction, followed by cooling. Then, 2.0 g of each sample solidified by cooling was subjected to the acid value measurement.

Subsequently, 40 parts by mass (0.21 moles) of trimellitic anhydride was added to the reaction vessel for reaction with the content for two hours under an atmospheric sealed condition. This yielded a polyester resin. The resulting polyester resin was cooled to room temperature, followed by pulverization into particles. As a result, the polyester resin A having the acid value (AV value) of 15.5 mgKOH/g, the hydroxyl value (OHV value) of 57.9 mgKOH/g, Tm of 75.2° C., Tg of 40.9° C., Mn of 2000, and Mw of 4200 was yielded.

<Method for Synthesizing Polyester Resin B>

A reaction vessel provided with a cooling tube, a stirrer, and a nitrogen inlet tube was charged with 379 parts by mass (1.2 moles) of bisphenol A-EO (ethylene oxide) 2 mole adduct, 447 parts by mass (1.3 moles) of bisphenol A-PO (propylene oxide) 2 mole adduct, 249 parts by mass (1.5 moles) of terephthalic acid, and 3 parts by mass of tetrabutoxytitanate as a condensation catalyst.

Subsequently, the content of the reaction vessel was reacted for 5 hours under a nitrogen stream and at 230° C. while the produced water distilled off. Subsequently, the content of the reaction vessel was reacted under a reduced pressure of 10 mmHg, and the temperature within the reaction vessel was cooled to 180° C. when the acid value (AV value) of the content of the reaction vessel reached 2 mgKOH/g or less. The acid value (AV value) was measured in accordance with JIS K 0070-1992.

Subsequently, 40 parts by mass (0.21 moles) of trimellitic anhydride was added to the reaction vessel for reaction with the content for two hours under an atmospheric sealed condition. This yielded a polyester resin. The resulting polyester resin was cooled to room temperature, followed by pulverization into particles. As a result, the polyester resin B having the acid value (AV value) of 18.0 mgKOH/g, the hydroxyl value (OHV value) of 21.2 mgKOH/g, Tm of 76.7° C., Tg of 42.9° C., Mn of 2100, and Mw of 4300 was yielded.

<Method for Synthesizing Polyester Resin C>

A reaction vessel provided with a cooling tube, a stirrer, and a nitrogen inlet tube was charged with 474 parts by mass (1.5 moles) of bisphenol A-EO (ethylene oxide) 2 mole adduct, 447 parts by mass (1.3 moles) of bisphenol A-PO (propylene oxide) 2 mole adduct, 249 parts by mass (1.5 moles) of terephthalic acid, and 3 parts by mass of tetrabutoxytitanate as a condensation catalyst.

Subsequently, the content of the reaction vessel was reacted for 5 hours under a nitrogen stream and at 230° C. while the produced water was distilled off. Then, the content of the reaction vessel was reacted under a reduced pressure of 10 mmHg, and the temperature within the reaction vessel was cooled to 180° C. when the acid value (AV value) of the content of the reaction vessel reached 2 mgKOH/g or less. The acid value (AV value) was measured in accordance with JIS K 0070-1992.

Subsequently, 40 parts by mass (0.21 moles) of trimellitic anhydride was added to the reaction vessel for reaction with the content for two hours under an atmospheric sealed condition. This yielded a polyester resin. The resulting polyester resin was cooled to room temperature, followed by pulverization into particles. As a result, the polyester resin C having the acid value (AV value) of 21.0 mgKOH/g, the hydroxyl value (OHV value) of 76.0 mgKOH/g, Tm of 77.7° C., Tg of 43.9° C., Mn of 2100, and Mw of 4300 was yielded.

<Method for Synthesizing Polyester Resin D>

A reaction vessel provided with a cooling tube, a stirrer, and a nitrogen inlet tube was charged with 474 parts by mass (1.5 moles) of bisphenol A-EO (ethylene oxide) 2 mole adduct, 447 parts by mass (1.3 moles) of bisphenol A-PO (propylene oxide) 2 mole adduct, 249 parts by mass (1.5 moles) of terephthalic acid, and 3 parts by mass of tetrabutoxytitanate as a condensation catalyst.

Subsequently, the content of the reaction vessel was reacted for 5 hours under a nitrogen stream and at 230° C. while the produced water was distilled off. Subsequently, the content of the reaction vessel was reacted under a reduced pressure of 10 mmHg, and the temperature within the reaction vessel was cooled to 180° C. when the acid value (AV value) of the content of the reaction vessel reached 2 mgKOH/g or less. The acid value (AV value) was measured in accordance with JIS K 0070-1992.

Subsequently, 40 parts by mass (0.21 moles) of trimellitic anhydride was added to the reaction vessel for reaction with the content for two hours under an atmospheric sealed condition. This yielded a polyester resin. The resulting polyester resin was cooled to room temperature, followed by pulverization into particles. As a result, the polyester resin D having the acid value (AV value) of 22.0 mgKOH/g, the hydroxyl value (OHV value) of 106.7 mgKOH/g, Tm of 78.0° C., Tg of 49° C., Mn of 2100, and Mw of 4300 was yielded.

(Preparation of Cores)

The respective methods for preparing Samples 1 to 12 each used one of the polyester resins A to D to prepare the cores. The respective methods for preparing Samples 1 to 12 involved one of the three methods (a pulverization/classification method, a dissolution-suspension granulation method, and a high-pressure emulsification aggregation method) shown below to prepare the cores. In addition, a precision particle size distribution measuring device ("Coulter Counter Multisizer 3" manufactured by Beckman Coulter, Inc.) was used to measure the volume average particle diameter ($D_{50}$) of the cores.

<Preparation of Cores by Pulverization/Classification Method>

In the pulverization/classification method, the cores of the toner particles contained in each sample (liquid developer) were prepared through the following processes. First, a binder resin and a colorant were mixed. More specifically, 1000 parts by mass of the polyester resin (one of the polyester resins A to D) and 250 parts by mass of the carbon black ("REGAL (registered trademark) 330R" manufactured by Cabot Corporation) were mixed by using a fluid-type mixer ("FM-20C/I" manufactured by Nippon Coke & Engineering Co., Ltd.) for five minutes at 45° C. or less.

Subsequently, the resulting mixture was kneaded by using a two open-roll continuous kneader ("Kneadex MOS-160" manufactured by Nippon Coke & Engineering Co., Ltd.). The resulting kneaded product was cooled. Subsequently, the kneaded product thus cooled was coarsely pulverized by using a cutter mill ("Rotoplex" manufactured by Hosokawa Micron Corporation), followed by pulverization by a mechanical pulverizer with a water-cooled rotor ("Turbo Mill" manufactured by FREUND-TURBO CORPORATION). Subsequently, the resulting pulverized product was classified by a classifier ("Elbow Jet" manufactured by Nittetsu Mining Co., Ltd.). In this manner, anionic cores having a volume average particle size ($D_{50}$) of 2.5 μm were obtained. The resulting cores were then washed and dried again.

<Preparation of Cores by Dissolution-Suspension Granulation Method>

The dissolution-suspension granulation method excels in the variety of usable resins, the easiness in adjusting the molecular weight, the blendability of the resin, and the sharpness in particle size distribution.

In the dissolution-suspension granulation method, the cores of the toner particles contained in each sample (liquid developer) were prepared through the following processes. First, a binder resin and a colorant were mixed. More specifically, 1000 parts by mass of the polyester resin (the polyester resin A) and 250 parts by mass of the carbon black ("REGAL (registered trademark) 330R" manufactured by Cabot Corporation) were mixed by using a fluid-type mixer ("FM-20C/I" manufactured by Nippon Coke & Engineering Co., Ltd.) for five minutes at 45° C. or less.

Subsequently, the resulting mixture was kneaded by using a two open-roll continuous kneader ("Kneadex MOS-160" manufactured by Nippon Coke & Engineering Co., Ltd.). Subsequently, 125 parts by mass of the resulting kneaded product was dissolved in 500 parts by mass of a MEK (methyl ethyl ketone) solvent to disperse the resin particulates in the solvent. As a result, a dispersion of black polyester resin particulates (oil phase) was prepared.

Subsequently, the dispersion (oil phase) prepared was mixed with an aqueous medium (aqueous phase) to prepare slurry (suspension). The aqueous medium used was prepared by dissolving 40 parts by mass (active constituent: 27% by mass) of an anionic surfactant (Emal E27C manufactured by Kao Corporation) in 1000 parts by mass of ion exchanged water.

Subsequently, the prepared slurry was stirred (for emulsification and dispersion) for 30 minutes at a rotation speed of 15,000 rpm by using an emulsifier ("CLEARMIX" manufactured by M TECHNIQUE Co., Ltd.) to form oil droplets (granulation). As a result, an oil-in-water (O/W) emulsion (emulsified slurry) was obtained.

The particle size of the oil droplets of the emulsified slurry (polymer particulates) tends to decrease with an increase in the stirring speed of the emulsifier, and the particle size distribution of the polymer particulates tends to be sharper with an increase in the stirring time. Thus, the stirring speed and the stirring time of the emulsifier were adjusted such that the volume average particle diameter ($D_{50}$) of the polymer particulates in the emulsified slurry would fall within the range of 0.5 μm to 5.0 μm. To ensure a sharp particle size distribution, the stirring time is preferably 10 minutes or longer, and more preferably 20 minutes or longer, and further more preferably 30 minutes or longer. Preferably, 80% by volume of the entire polymer particulates contained in the emulsified slurry falls within the range of "volume average particle diameter (D50)±1 μm)", and more preferably falls within the range of "volume average particle diameter $D_{50}$)±0.5 μm".

Subsequently, the resulting emulsified slurry was heated to remove the organic solvent in the slurry by evaporation. In this manner, anionic cores having a volume average particle size ($D_{50}$) of 2.5 μm were obtained. The resulting cores were then washed and dried again.

<Preparation of Cores by High-Pressure Emulsification Aggregation Method>

In the high-pressure emulsification aggregation method, the cores of the toner particles contained in each sample (liquid developer) were prepared through the following processes. First, a binder resin and a colorant were mixed. More specifically, 1000 parts by mass of the polyester resin (the polyester resin A) and 250 parts by mass of the carbon black ("REGAL (registered trademark) 330R" manufactured by Cabot Corporation) were mixed by using a fluid-type mixer ("FM-20C/I" manufactured by Nippon Coke & Engineering Co., Ltd.) for five minutes at 45° C. or less.

Subsequently, the resulting mixture was kneaded by using a two open-roll continuous kneader ("Kneadex MOS-160" manufactured by Nippon Coke & Engineering Co., Ltd.). Thereafter, the resulting kneaded product was cooled. Subsequently, the kneaded product thus cooled was coarsely pulverized by using a cutter mill ("Rotoplex" manufactured by Hosokawa Micron Corporation), followed by pulverization by a supersonic jet pulverizer ("LJ-3" manufactured by Nippon Pneumatic Mfg. Co., Ltd.). As a result, a dispersion of black polyester resin particulates having a volume average particle diameter ($D_{50}$) of 28 μm was obtained.

Subsequently, the resulting black polyester resin particulates were added to an aqueous medium (ion exchanged water) together with a surfactant to prepare slurry (suspension).

Subsequently, the resulting slurry was heated to 165° C., which is higher than the melting point of a polyester resin, to melt the polyester resin in the slurry, followed by application of a strong shear force to pulverize the polyester resin into particulates. More specifically, a high-pressure emulsifier ("Nanomizer" manufactured by YOSHIDA KIKAI CO., LTD.) was used to perform to a 3-pass process (three-time emulsification) at a discharge pressure of 50 MPa. As a result, a dispersion of black polyester resin particulates was obtained.

Subsequently, a coagulant was added to the resulting dispersion, followed by stirring of the dispersion under the temperature control of the dispersion. As a result, the particles in the dispersion was caused to grow (aggregate and coalesce). Subsequently, the dispersion containing the grown particles was cooled to room temperature, followed by solid-liquid separation (filtering). In this manner, anionic cores having a volume average particle size ($D_{50}$) of 2.5 μm were obtained. The resulting cores were then washed and dried again.

(Shell Layer Formation)

In the respective manufacturing methods for Samples 1-12, the shell layers were formed through the following processes to coat the cores formed in the above described manner.

First, a 1 L three-necked flask equipped with a thermometer and a stirring blade was set in a water bath. Then, the temperature within the flask was kept at 30° C. by using the water bath. Subsequently, the flask was charged with 300 mL of ion exchanged water, and dilute hydrochloric acid was further added thereto to adjust the pH of the aqueous medium (the ion exchanged water) within the flask to 4.

Subsequently, 6 mL of a methylated melamine formaldehyde initial condensate ("mirben resin SM-607" manufactured by Showa Denko K.K., having a solid content concentration of 80% by mass) was added to the flask as a shell material. The content of the flask was stirred to dissolve the methylated melamine formaldehyde initial condensate in the aqueous medium. The amount of the shell material to be added was determined so as to form the shell layers having a thickness of 6 nm Subsequently, to the flask (to the solution in which the shell material was dissolved), 300 g of the cores prepared by the one of the aforementioned methods (either the pulverization/classification method, the dissolution-suspension granulation method, or the high-pressure emulsification aggregation method) and having a volume average particle diameter ($D_{50}$) of 2.5 μm were added, and the content of the flask was stirred at a speed of 200 rpm.

Thereafter, 300 mL of ion exchanged water was added to the flaks, and the temperature within the flask was increased to 70° C. at a rate of 0.5° C./min while the content of the flask was stirred at 100 rpm. Thereafter, the content of the flask was stirred for 2 hours at 70° C. and 100 rpm. Thus, the cationic shell layers each coating the surface of a core was formed from a thermosetting resin (melamine resin).

After the temperature within the flask was kept at 70° C. for 2 hours, sodium hydroxide was added to the flask to adjust the pH of the content of the flask to 7. Subsequently, the content of the flask was cooled to room temperature. As a result, a dispersion containing toner particles was obtained.

(Washing of Toner Particles)

The toner particles thus formed were washed. The dispersion was subjected to the solid-liquid separation (filtration) by using a Buchner funnel to obtain the toner particles in the form of a wet cake. Then, the toner particles in the form of a wet cake were dispersed again in ion exchanged water to wash the toner particles. Such washing with ion exchanged water (including filtration and dispersion) was repeated five times. The conductivity of the filtrate after the washing (i.e., the washing water) was 4 μS/cm. The conductivity was measured by using an electrical conductivity meter "HORIBA ES-51" manufactured by Horiba Ltd. The TOC concentration of the filtrate after the washing (the washing water) was 8 mg/L or less. Thereafter, the TOC concentration of the filtrate (the washing water) was successfully lowered to 3 mg/L or less (corresponding to the level of tap water) by general reverse osmosis (RO). For measuring the TOC concentration, "TOC-4200" manufactured by Shimadzu Corporation was used.

(Drying of Toner Particles)

After washing the toner particles as described above, the toner particles were dried. The toner particles collected from the dispersion were dried by allowing them to stand in an atmosphere of 40° C. for 48 hours. As a result, an electrostatic latent image developing toner containing numerous toner particles was manufactured.

(Process for Dispersing Toner Particles in Carrier Liquid)

First, 20 parts by mass of each toner manufactured in the manner described above, 2 parts by mass of a dispersant, and 78 parts by mass of an electrically insulating carrier liquid were premixed. As will be described later, the dispersant and the carrier liquid used were determined specifically for the respective samples.

The resulting mixture was subjected to dispersion for 5 minutes by using an ultrasonic disperser, followed by further dispersion at a pressure of 50 MPa by using a high-pressure disperser ("Nanomizer" manufactured by YOSHIDA KIKAI CO., LTD.). As a result, the liquid developers (Samples 1 to 12) were prepared.

[Evaluation Method]

Samples 1 to 12 were evaluated by the following method. It is noted that the cores (the cores of the toner particles contained in each sample) were evaluated before capsulation (formation of the shell layers).

(Zeta Potential)

First, 100 g of water (ion exchanged water) in which 0.1% by mass of a nonionic surfactant ("EMULGEN 120" manufactured by Kao Corporation) was dissolved was prepared, and 1 g of the particles of a corresponding sample (cores or toner particles) were added to the water to obtain a mixture liquid. Subsequently, the resulting mixture liquid was subjected to dispersion for 3 minutes by using an ultrasonic disperser to obtain the dispersion of the particles (cores or toner particles) of the corresponding sample. Subsequently, dilute hydrochloric acid or an aqueous sodium hydroxide solution was added to the resulting dispersion to adjust the pH of the dispersion to 4. Then, the zeta potential of the cores (cores or toner particles) in the dispersion adjusted to pH 4 was measured at a temperature of 23° C. by using a zeta potential measuring instrument ("ELSZ-1000" manufactured by Otsuka Electronics Co., Ltd.). The measurements were made three times under the same condition and the average of the three measurement values was determined as the evaluation value.

(Roundness)

The roundness of the cores or toner particles of each sample was measured by using a flow type particle image analyzer ("FPIA (registered trademark)-3000" manufactured by Sysmex Corporation). More specifically, the roundness of 3,000 cores or toner particles per sample were measured, and the average of the measurement values of the 3000 cores or toner particles was determined as the evaluation value.

(Tg of Toner Particles)

A heat absorption curve of the toner particles of each sample was measured by using a differential scanning calorimeter ("DSC-6200" manufactured by Seiko Instruments Inc.). Then, the Tg (glass transition point) of the toner particles of the sample was determined on the basis of a point of change in specific heat on the heat absorption curve.

(Tm of Toner Particles)

The toner particles of each sample were set to an elevated flow tester ("CFT-500D" manufactured by Shimadzu Corporation). Then, an S shaped curve was obtained by causing 1 $cm^3$ of the toner particles to be melt flown under the conditions of a die diameter of 1 mm, a plunger load of 20 $kg/cm^2$, and a temperature increasing rate of 6° C./min. Then, the Tm (softening point) of the toner particles of the sample was read from the thus obtained S shaped curve.

(Preservability)

First, to evaluate the preservability of each sample, a 100 mL glass bottle was charged with 50 mL of the sample (liquid developer) and left to stand still for 24 hours in a thermostat heated to 50° C. (subjected to a heat-resistance test). Then, the preservability was evaluated based on the particle sizes of the toner particles in the liquid developer before and after the test. More specifically, before and after the test, the volume average particle diameter ($D_{50}$) of the toner particles contained in each sample was measured by using a laser diffraction/scattering type particle size distribution analyzer ("Partica LA-950V2" manufactured by HORIBA, Ltd.). Then, each sample is evaluated as "Good" if the value given by "volume average particle diameter ($D_{50}$) after the test/the volume average particle diameter ($D_{50}$) before the test" is less than 1.1 and as "Poor" if the value is 1.1 or more.

(Image Density)

Each sample (liquid developer) was set to an image forming apparatus to measure the density of images formed by the image forming apparatus. The images were formed by using an image forming apparatus 100 shown in FIG. 3. The following describes the image forming apparatus 100 used for evaluating the image density, mainly with reference to FIG. 3.

Figure 3:
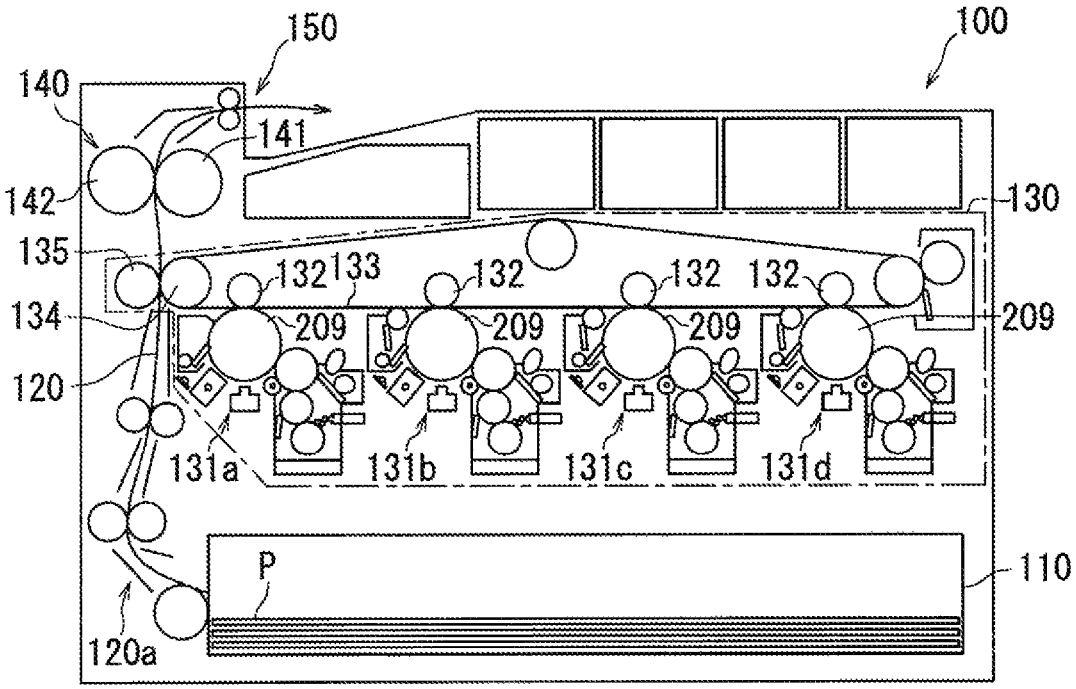
FIG. 3 is a schematic illustration of an image forming apparatus used to evaluate the image densities for liquid developers according to Examples of the present disclosure and Comparative Examples.

As shown in FIG. 3, the image forming apparatus 100 includes an accommodating section 110 for accommodating recording sheets P (printing paper), a conveyance path 120 for conveying a recording sheet P, an image forming section 130 for forming an image on the recording sheet P, a fixing device 140 for fixing the image on the recording sheet P, and a discharging section 150 for discharging the recording sheet P on which the image is fixed. The conveyance path 120 connects the accommodating section 110 to the discharge section 150. The conveyance path 120 is provided with a conveyor device 120*a* for conveying each recording sheet P from the accommodating section 110 to the discharge section 150.

The image forming section 130 includes developing units 131*a* to 131*d* (each of which may be referred to simply as the "developing unit 131" when the respective developing units need not be distinguished), a plurality of primary transfer rollers 132, a transfer belt 133, a support roller 134, and a secondary transfer roller 135. To each of the developing units 131*a*, 131*b*, 131*c*, and 131*d*, the sample (liquid developer) is supplied. The following describes the structure of each developing unit 131, mainly with reference to FIG. 4.

Figure 4:
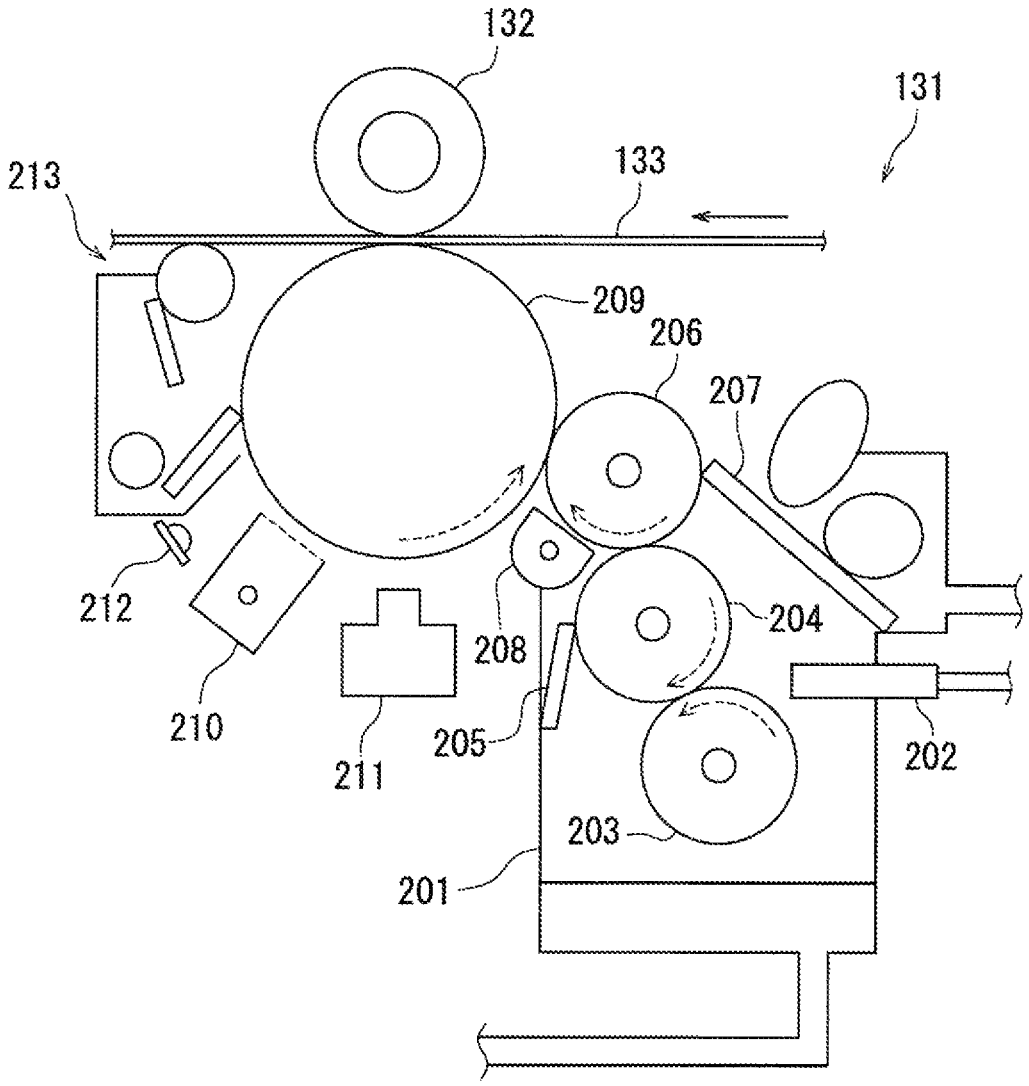
FIG. 4 is a schematic illustration showing, on an enlarged scale, a developing unit of the image forming apparatus shown in FIG. 3.

As shown in FIG. 4, the developing unit 131 includes a developer container 201, a nozzle 202, a support roller 203, a supply roller 204 (anilox roller), a supply roller blade 205, a developer roller 206, a developer cleaning blade 207, a developer-roller charging device 208, a photosensitive drum 209, a charging device 210, an exposure device 211, a static eliminator device 212, and a cleaner device 213. The photosensitive drum 209 is formed form amorphous silicon. The amorphous silicon is highly stable against the carrier liquid contained in the sample (liquid developer). The charging device 210 uniformly charges the surface of the photosensitive drum 209. The exposure device 211 emits light from an LED to form an electrostatic latent image on the surface of the photosensitive drum 209 according to the image data.

The sample (liquid developer) is supplied from a non-illustrated toner tank to the supply roller 204 through the nozzle 202. The supply roller 204 is in contact with the developer roller 206, so that the sample (liquid developer) is supplied from the supply roller 204 to the developer roller 206. The developer-roller charging device 208 charges the developer roller 206 (and thus charges the toner particles). A potential difference exists between the developer roller 206 and the photosensitive drum 209. The developer roller 206 is in contact with the photosensitive drum 209, so that the electrostatic latent image formed on the surface of the photosensitive drum 209 is developed by the sample (liquid developer) residing on the surface of the developer roller 206.

With reference to FIG. 3, the following continues the description of the image forming apparatus 100. Each photosensitive drum 209 is opposed to the corresponding primary transfer roller 132 across the transfer belt 133. When a voltage of a reverse polarity to the sample (liquid developer) forming the image is applied to the primary transfer roller 132, the image developed on the surface of the photosensitive drum 209 is transferred to the transfer belt 133.

The support roller 134 supporting the transfer belt 133 is opposed to the secondary transfer roller 135 across the transfer belt 133 and the conveyance path 120. When the recording sheet P conveyed through the conveyance path 120 contacts the transfer belt 133, the image formed on the transfer belt 133 is transferred to the recording sheet P.

The fixing device 140 fixes the image (toner image) to the recording sheet P with the use of a heating roller 141 and a pressure roller 142. After the fixing by the fixing device 140, the recording sheet P is discharged to the discharge section 150.

To evaluate the image density, the image forming apparatus 100 formed images under the following conditions.

System speed: 410 mm/sec

Photosensitive member (positively chargeable): amorphous silicon

Photosensitive member potential: dark potential+550 V/light potential 0 V

Developing voltage (voltage applied to developer roller): +400 V

Primary transfer voltage (voltage applied to transfer roller): +300 V

Secondary transfer electric current: −20 μA

Fixing roller temperature: 120° C.

To measure the image density (ID), a reflection densitometer ("Densitometer PDM5" manufactured by SAKURA Co., Ltd.) was used. Each sample is evaluated as "Good" if the measurement value (ID) was 1.2 or more and as "Poor" if the measurement value (ID) was less than 1.2.

(Fixability)

Each sample (liquid developer) was charged into the developing unit 131 of the image forming apparatus 100 shown in FIG. 3 and solid images (30 mm×30 mm) were formed on paper by using the image forming apparatus 100. More specifically, the temperature of the fixing roller was controlled to fall within the range of 100° C. to 240° C. to fix an image (toner image) on the paper. Thereafter, a fastness test was performed using a Gakushin-type fastness tester. More specifically, an eraser ("LION261-11" manufactured by LION OFFICE PRODUCTS CORP.) was used under a pressure load of 9.8 N to rub each fixed image by making three reciprocating motions. Then, the image density was measured before and after the rubbing by using a reflection densitometer ("Densitometer PDM5" manufactured by SAKURA Co., Ltd.) and the fixation ratio was calculated in accordance with Formula 2 below.

$$\text{Fixation Ratio (\%)}=[(\text{Image Density after Rubbing})/(\text{Image Density before Rubbing})]\times 100 \quad \text{[Formula 2]}$$

The temperature of the fixing roller was gradually increased from 100° C. to determine the temperature at which the fixation ratio exceeded 80% as the lowest fixation temperature. The amount of toner adhered to the paper was 1.0 mg/cm$^2$.

In addition, the temperature of the fixing roller was increased from 100° C. by 5° C. to determine the highest temperature up to which no offset occurred (no toner adhered to the fixing roller) as the highest fixation temperature. The amount of toner adhered to the paper was set to 1.0 mg/cm$^2$.

[Samples and Evaluation Results]

FIG. 5 is a table comprehensively showing the evaluation results on the liquid developers manufactured by the manufacturing method according to Examples of the present disclosure (Samples 1 to 6) and on the liquid developers manufactured by the manufacturing method in which one or more processes of the manufacturing methods according to the present disclosure were omitted (Samples 7 to 12).

(Samples)

The following describes Samples 1 to 12, mainly with reference to FIG. 5.

The manufacturing method for Sample 1 involved a process of dispersing the toner particles in the carrier liquid (more specifically, premix). In the dispersing process, "Solsperse 11200" manufactured by Lubrizol Corporation was used as the dispersant, and "IP Solvent 1620" manufactured by Idemitsu Kosan Co., Ltd. was used as the carrier liquid. To prepare the cores of the toner particles of Sample 1, the polyester resin A was used as the binder resin and the pulverization/classification method was employed.

The manufacturing method for Sample 2 involved a process of dispersing the toner particles in the carrier liquid (more specifically, premix). In the dispersing process, "Solsperse 11200" manufactured by Lubrizol Corporation was used as the dispersant, and "Isopar H" manufactured by Exxon Mobil Corporation was used as the carrier liquid. To prepare the cores of the toner particles of Sample 2, the polyester resin A was used as the binder resin and the dissolution-suspension granulation method was employed.

The manufacturing method for Sample 3 involved a process of dispersing the toner particles in the carrier liquid (more specifically, premix). In the dispersing process, "Antaron V-220" manufactured by ISP Japan Ltd. was used as the dispersant, and "MORESCO WHITE P-55" manufactured by MORESCO Corporation was used as the carrier liquid. To prepare the cores of the toner particles of Sample 3, the polyester resin A was used as the binder resin and the high-pressure emulsification aggregation method was employed.

Sample 4 was prepared by the same manufacturing method as the manufacturing method for Sample 1, except that the polyester resin B was used instead of the polyester resin A in the process of forming the cores.

Sample 5 was prepared by the same manufacturing method as the manufacturing method for Sample 1, except that the polyester resin C was used instead of the polyester resin A in the process of forming the cores.

Sample 6 was prepared by the same manufacturing method as the manufacturing method for Sample 1, except that the polyester resin D was used instead of the polyester resin A in the process of forming the cores.

Sample 7 was prepared by the same manufacturing method as the manufacturing method for Sample 1, except that no shell layers were formed.

Sample 8 was prepared by the same manufacturing method as the manufacturing method for Sample 2, except that no shell layers were formed.

Sample 9 was prepared by the same manufacturing method as the manufacturing method for Sample 3, except that no shell layers were formed.

Sample 10 was prepared by the same manufacturing method as the manufacturing method for Sample 4, except that no shell layers were formed.

Sample 11 was prepared by the same manufacturing method as the manufacturing method for Sample 5, except that no shell layers were formed.

Sample 12 was prepared by the same manufacturing method as the manufacturing method for Sample 6, except that no shell layers were formed.

(Evaluation Results)

Next, the following describes the evaluation results of Samples 1 to 12, mainly with reference to FIG. 5.

The zeta potential of each of Samples 1 to 12 at pH 4 before capsulation (the cores) was −20 mV or less. Yet, Samples 1 to 6 were then subjected to the shell layer formation (capsulation), and the zeta potential after the capsulation (the toner particles) at pH4 was 50 mV or more (52 mV to be more specific). It is presumed for Samples 1 to 6 that the chargeability of the capsule toners (toner particles) was strong and thus the charge mobility in the carrier liquid improved. In addition, the improved charge mobility in the carrier liquid is presumed to be effective for developing an electrophotographic latent image with high speed and fidelity.

Samples 1 to 12 all exhibited that the Tm (softening point) of the toner particles was 80° C. or less. Samples 1 to 12 all exhibited that the roundness of the toner particles were within the range of 0.95 to 0.99. It should be noted that the roundness of Sample 7 was 0.950, whereas the roundness of Sample 1 provided with the shell layers was 0.955. This is assumed to indicate the following. That is, in the case where the roundness of the cores before capsulation is low, the roundness of the cores can be improved by providing the shell layers (by capsulation).

Samples 1 to 6 (the liquid developers containing the toner particles having a shell layer) compare favorably with Samples 7 to 12 (the liquid developers containing the toner particles without a shell layer) in the preservability. The presence of a thermosetting resin (shell layer) on the surface of each core is assumed to have improved the preservability of the liquid developer.

Samples 1 to 6 all exhibited the lowest fixing temperature of 135° C. or less. In addition, the image density was higher when the images were formed by using Samples 1 to 6 than by using Samples 7 to 12.

As has been described above, Samples 1 to 6 (each being a liquid developer) contained the toner particles having a shell layer containing a thermosetting resin (melamine resin). Each liquid developer having such a structure (each of Samples 1 to 6) exhibited excellent preservability and fixability. In addition, with the use of the liquid developer containing toner particles each having a shell layer formed from a resin having a high positive chargeability, the images can be formed at a desired image density.

The liquid developer manufacturing methods for Samples 1 to 6 (the manufacturing method according to Examples of the present disclosure) each include forming cores; forming shell layers each on the surface of a core through a polymerization reaction of a methylated melamine formaldehyde initial condensate on the surface of the core; and dispersing the toner particles each having a core and a shell layer in an electrically insulating liquid carrier. According to the liquid developer manufacturing method having such a structure, a liquid developer having the above structure (liquid developer containing toner particles having a shell layer containing a thermosetting resin) can be manufactured easily and appropriately.

The present disclosure is not limited to Examples described above.

For example, any method for preparing cores can be selected. The method for preparing the cores may be a wet process (for example, a suspension polymerization method, an emulsion aggregation method, a non-aqueous dispersion polymerization method, an emulsification dispersion granulation method, or a seed polymerization method) or a dry process (for example, spray drying method or a grinding method). It is preferable to select an appropriate method according to the binder resin, the particle size, the shape or the like of the cores.

In addition, the toner particles manufactured by a wet process is not required to be fully dried before dispersion into the carrier liquid. For example, the wet cake of toner particles may be prepared by removing water from the slurry by filtering or the like to have the water content of 10% by mass or so and the wet cake is then dispersed into the carrier liquid. Thereafter, the carrier liquid may be subjected to vacuum distillation under stirring to remove water from the toner particles, followed by solvent displacement (flushing).

The binder resin for forming the cores is not limited to a polyester resin and can be appropriately selected. For the material of the shell layers, methylol melamine is preferred. However, the material of the shell layers may be any resin that can form a thermosetting resin. For example, benzoguanamine, acetoguanamine, or spiroguanamine may be used as the material of the shell layers.

What is claimed is:

1. A liquid developer comprising:
an electrically insulating liquid carrier; and
non-photosensitive toner particles dispersed in the liquid carrier, wherein each toner particle include
a core, and
a shell layer that is formed on a surface of the core and contains a thermosetting resin,
the core contains a polyester resin,
the shell layer contains an amino aldehyde resin as the thermosetting resin,
a zeta potential of the cores at pH 4 is −43 mV or more and below 0 V, and
a zeta potential of the toner particles at pH 4 is above 0 V and 52 mV or less.

2. A liquid developer according to claim 1, wherein
the core further contains carbon black.

3. A liquid developer according to claim 1, wherein
the shell layers contain a melamine resin or a derivative of the melamine resin.

4. A liquid developer according to claim 1, wherein
the polyester resin is a polyester resin having a hydroxyl value of 20 mgKOH/g or more and 106.7 mgKOH/g or less.

5. A method for manufacturing a liquid developer, comprising:
preparing cores;
forming, on a surface of each core, a shell layer containing a melamine resin or a derivative of the melamine resin through a polymerization reaction of an initial condensate of melamine formaldehyde or a derivative of the melamine formaldehyde on the surface of the core; and
dispersing the toner particles each having the core and the shell layer in an electrically insulating liquid carrier.

6. A method for manufacturing a liquid developer, according to claim 5, wherein
the cores contain a polyester resin having a hydroxyl value of 20 mgKOH/g or more.

7. A liquid developer according to claim 1, wherein
the toner particles each have a roundness of 0.95 or more and 0.99 or less.

* * * * *